US005834690A

United States Patent [19]

Bastiaansen

[11] Patent Number: 5,834,690

[45] Date of Patent: Nov. 10, 1998

[54] SPATTER, DUST AND RAIN-PROOF PLASTIC SAFETY CASE INTENDED FOR EXTENSION CORD PLUGGING

[75] Inventor: Christ A. C. A. Bastiaansen, Zevenbergen, Netherlands

[73] Assignee: Bato Trading BV, Zevenbergen, Netherlands

[21] Appl. No.: 530,250

[22] PCT Filed: Aug. 23, 1994

[86] PCT No.: PCT/EP94/02781

§ 371 Date: Sep. 28, 1995

§ 102(e) Date: Sep. 28, 1995

[87] PCT Pub. No.: WO95/20830

PCT Pub. Date: Aug. 3, 1995

[30] Foreign Application Priority Data

Jan. 31, 1994 [NL] Netherlands ..... 9400148

[51] Int. Cl.[6] ..... H01R 13/52

[52] U.S. Cl. ..... 174/52.1

[58] Field of Search ..... 174/52.1, 68, 48, 174/17 CT, 77 R, 91–93; 439/367, 369; 220/3.8, 240

[56] References Cited

U.S. PATENT DOCUMENTS

| | | | |
|---|---|---|---|
| 3,344,393 | 9/1967 | Hendee | 439/369 |
| 4,002,818 | 1/1977 | Kunze | 174/21 R |
| 4,241,967 | 12/1980 | Collins | 439/589 |
| 4,643,505 | 2/1987 | House et al. | 339/75 P |
| 5,129,839 | 7/1992 | Vanskiver | 439/367 |
| 5,135,409 | 8/1992 | Thompson | 439/367 |
| 5,217,387 | 6/1993 | Hull et al. | 439/367 |
| 5,259,782 | 11/1993 | Giffin | 439/367 |
| 5,299,951 | 4/1994 | Blaetz | 439/367 |
| 5,531,345 | 7/1996 | Nakamura et al. | 220/3.8 |

FOREIGN PATENT DOCUMENTS

| | | | |
|---|---|---|---|
| 2202692 | 9/1988 | United Kingdom | H01R 13/502 |

*Primary Examiner*—Kristine L. Kincaid
*Assistant Examiner*—Joseph Waks
*Attorney, Agent, or Firm*—Kenyon & Kenyon

[57] ABSTRACT

A weatherproof safety case for a plug and receptacle connection of electrical power cords. The case includes a molded plastic housing divided into first and second parts having mating edges. An integrally molded hinge of thin plastic material joins the first and second parts along one side of the mating edges. A clasp-like member extends alongside one of the mating edges. The resilient gasket is formed with an enlarged pad adjacent to each end of the hinge for providing a seal between the hinge and the mating edges when the case is shut. The case also includes labyrinth seals, each labyrinth seal being divided into two portions by the mating edges of the first and second parts of the housing Each portion is coupled to either the first or second part of the housing, and is formed with at least two spaced apart flexible partitions having semicircular edge cutouts. One of the edge cutouts is of a larger diameter than the other. Portions of each of the labyrinth seals are engagable with the partitions in the labyrinth seals of the other of the parts. The clasp-like member is arranged to lock the parts together. The housing is a cylinder with convex ends, and the first and second labyrinth seals are located in opposite ends of the cylinder. The clasp-like member on the one part fits against an outside surface of the gasket on the other part to provide an overlapping seal.

3 Claims, 3 Drawing Sheets

SECTION A-A.

SECTION C-C.

SECTION B-B

DETAIL D

SPATTER, DUST AND RAIN-PROOF PLASTIC SAFETY CASE INTENDED FOR EXTENSION CORD PLUGGING

The invention relates to a case intended for safe covering male and female extension cord plug connections, especially for outdoors use to connect electrical droven hand tools and portable apparatus such as vacuum cleaners to the mains. Problems possibly occuring are well-known, for example ease disconnecting by cord tension;

easely accessibility by infants;

short circuiting caused by spattering or rain;

gutter-water and soggy swards;

corroded electrodes in the long run.

The case according to the invention is designed to avoid all these dangerous situations and consists of a nearly cylindrical tube with hemispherical fronts. The container is partited in a upper and lower part in a plane coinciding with its longitudinal centerline, while both parts are connected to each other by a hinge-joint, being a thin material layer created during the injection molding process.

After being closed by a click fastener system, the case parts are effectually secured.

Adults are enabled to unbold by simultaneously putting the thumb into the free counter-sink space on the shell circumference near it and pulling the grip.

For safety reasons construction details, dimensions and required force are such as to make this handling impossible for infants.

Waterproof plug connections already on the market and guaranteed for under water use as well, are serving a different purpose and subjected to governmental requirments and rules, as such not competitive with the case according to this invention which is adapt for domestic use in circumstances where spatter and rain-proof sealing is considered as very essential to protect users of portable current consumers against electric shock which can be fatally.

Short circuiting can also be caused by corroded electrodes due to penetrating moisture and wet when extension cords are outdoors used and that is where the invention emphatic provides for as well.

Plug cases not equiped with this provision do not meet basic safety secure against danger being connected with the use of electrical tools and equipment in the open air under bad wether conditions an/or dusty enviromental conditions. For said reasons the innovative vallue of the case according to the invention shall be concentrated to the lapping sealing along the contacting surfaces of upper and lower case part in closed position, especially at the spot of areas where one sealing construction changes into another, for example on either side of the hinge joint where small adjoining square rubber gaskets guarrantee for uninterrupted sealing, keeping dash water, spattering and rain away from that wet penetration sensitive area.

Although the gaskets in the circumference of the partited hemisphericals of the two case parts are accordingly the male and female type, the rubber sealing opposite the hinge does have its base molded to recessed edges, necessarily due to the click fastening system which is situated in the same plane.

Self-evidently the sealing along those edges is going to be male and female like also while securing the clasp and finaly the case becomes closed, resulting in an uninterrupted sealing, jointing with those of the end closures.

Resumptionive it may be ascertained that along the edges of both case halfs a sound sealing condition is realized.

Sealing of the cable inside the nozzle is attained by means of a internal rubber labyrinth arranged in such a way as to allow diffenent cable thicknesses, leaving the sealing behaviour unimpeded in consequence of a converging bore.

For each cable thickness there will be at least two active pairs of semi-circular bored rubber partition skirts available.

It has to be mentioned that the material flexibility of these skirts is also defining for optimal cable sealing results.

This sealing nozzles contributes essentially to the overall sealing behaviour of the case according to this invention.

Safe plug connection in circumstances where electricity and water are used simultaneously can be referred to as one of the most important applications for the invention, for example when somebody is handling the garden-hose outside while another one is at work on vacuum cleaning the inside of a car at the same time.

Other applications worthy of being recorded are Christmas tree lighting when outdoors and electricity sypply for caravans; moreover for all extension cord plug-in purpose for general use.

One embodiment of the invention shall be explained by way of example in which less relevant details are emitted for the sake of clearness, with reference to the accompanying drawings, in which:

FIG. 1 represents a view in the fully opened case, with male and female plug in position, longitudinal fixed by means of an adjustable half open seat, on its sliding side provided with tooths, corresponding with those molded inside the case bottom, while the cleats in the contra half this position maintain as long as the case remains secuted.

FIG. 2 represents a front view according to arrow "P" of the opened case. In this drawing dotted lines to trace invisible backwards laying construction details are consciously omitted, just like the out lines of the plug which should be partly visible, in order to avoid confusing.

The adjustable seat outlines are hided by one of the fixed part-partition plates molded to the front closures of the bottom part and coinciding with its tangent line.

The injection molded hinge between upper and lower part as well as the oubolted fastener-hinge are clearly visible in this view.

FIG. 3 represents a side view of the case when closed.

FIG. 4 the same, however with unbolded cross sectional drawn click-fastener detail.

FIG. 5 shows the bottom part of the adjustable half open seat, with which the combined plug connection can be fixed, independent its shape and dimensions as far as situated within the limitations given by the internal housing dimenssions.

FIG. 6 represents a front view of the adjustable seat, provided with a slotted hole for cable transit, corresponding with the slotted hole in the fixed part partition plate coinciding with the front tangent line.

FIG. 7 represents a detail of the labyrinth sealing for cable transit, seen in upper view.

FIG. 8 the same, however in the front view.

FIG. 9 gives a cross sectional detail of the hard plastic male and medium hard rubber female fasket construction in the circumference of the hemispherical fronts, with the conical shaped male part shown in dotted lines.

FIG. 10 represents a construction detail of the sealing opposit the hinge in the situation before the click system became fastened.

FIG. 11 shows the labyrinth sealing construction as fitted into the cable nozzle and its converging wise bored partitions.

FIG. 12 shows one of the small rubber squares on either side of the hinge; apparently a minor detail however very essential for adequate sealing with regard to the lapping function between hinge and partited hemispherical front gaskets, keeping the penetrating moisture, wet and dust away.

In order to avoid misunderstandings, firstly construction of the case itself shall be described in detail. Just necessarily mentioning sealing provisions which will be accentuated in detail afterwards.

CASE DESIGN:

The lower case half 1, being the part in which the plug combination is fitted, is provided with semi-hemispheres 2, each with semicircular labyrinth sealings 3 in the center.

By means of the hinge 4 (being a small and thin material layer, created during the injection molding process), the lower case half 1 is jointed to the upper case half 5 and provided with semihemispheres 6, though these parts do have labyrinth sealings 3, seamless jointing the grooved rubber gasket 7 along the circumferential edges of the semi-hemispherical front closures 6. The grooved rubber gasket 7 is corresponding with the ledge 8, molded to the semi-hemispherical end closures 2.

Positioning of plug combination 9 by means of the adjustable seat 10 by moving this seat in the direction of the end partition plate 12, which handling needs the positive toothing 11, molded to the bottom of case half 1, while the cable 13 is seated on the labyrinth sealing half 3.

The cams 14 are intended to avoid obliqueness of seat 10. The way in which the ledge 8, molded to the front edges, is corresponding with the groof 15 which is injection molded into the rubber gasket 7 of the semi-hemispherical fronts 6, is in accordance with the way in which the ledge 16 of the lower case part 1 corresponds with the sealing opposite the hinge on the edge of the upper case part 5, after closing and securing both halfs by means of clast 17, finaly also forming a male and female type sealing. In the bolted condition—that means the situation existing as soon as the case halfs 1 and 5 are closed, after positioning of the plug combination 9 and firmly pressing the clast 17 with its cam into the corresponding free space 19 in longitudinal direction of the upper case half 5—the overall sealing can be described as follows:

SEALING:

The sealing properties of the case according to the invention is very essential for its functioning under all conditions for which it is designed for, especially bad wether and less ideal environmental conditions.

Otherwise the expected sheltering for outdoors use of plugging extension cords will just deceptively ends in. Can be even more dangerous than taking no measures at all!

In order to meet the aforesaid requirements the fabrication methode is such as to achieve fusing rubber gasket and plastic housing material in a second preheated mould which results in a much higher precicion grade compared with cold molding or hot vulcanizing procedures outside the mould.

The ledge 8 sinks with his bevelled side into the rubber groove 15 of the sealing gasket 7, as described above, hot applicated to the edges of the semi-hemispherical end closures 6.

The rubber gasket 20, jointed to rubber gasket 7, is recessed constructed in such a way that, after securing by closing and click fastening, the circular cross sectional form nearly remains as original and no parts are sticking out.

However, in closed condition an uninterrupted sealing surface exist because of the profile 20 which joints the grooved rubber sealing 7. This groove 7 is provided with the same recessed construction as the upper case half 5.

Along the small strip surface on the lower case part 1 (adjacent to hinge 24), the clasp 17 itself shall touch the outside surface of the longtudinal gasket 20, in this way effectuating a triangle sealing function along the closing side between the edges of the semi-hemispherical end closures 2 and 6; a function as it were added to its bolting and securing functioning.

The corresponding semi-circular labyrinth gaskets 3 do seal the cables 13 at least such as to achieve sufficient tightness, each pair acting like an orifice.

For the transition area on either side of self sealing hinge 4, a small rubber square 22 is provided which, moulded to the main grooved rubber gasket 7 on the semi-himispherical fronts 6, takes care for the sealing gap between both systems.

When this measure should be deleted, leakage will surely occur. This and above mentioned and described sealing details are very characteristic for the overall tightness of the case according to the invention. An invention intended for safe outdoors use of extension cords with regard to the male and female plug connections, wherefore sealing behaviour got much attention, especially when compared with cases serving the same purpose and already in use, but with different construction details.

The free thumb space 23 in the upper case 5 facilitates ease unbolting of the click fastener 17, also called clasp, but the required force is such as to make that handling impossible for infants and smaller children in general.

I claim:

1. A weatherproof safety case for a plug and receptacle connection on respective ends of two electrical power cords, the case comprising;

a molded plastic housing divided into first and second parts having mating edges, an integrally molded hinge of thin plastic material joining the first and second parts along one side of said mating edges to permit pivoting the first and second parts between open and shut positions, and a clasp-like member extending alongside one of said mating edges of one of the parts opposite the hinge for releasably locking the first and second parts in the shut position;

a resilient gasket forming one of said mating edges of one of the first and second parts, the resilient gasket being formed with an enlarged pad adjacent to each end of the hinge for providing a seal between the hinge and the mating edges when the case is shut;

first and second labyrinth seals, each labyrinth seal being divided into two portions by the mating edges of the first and second parts of the housing, each portion coupled to one of the first and second parts of the housing, and being formed with at least two spaced apart flexible partitions having semicircular edge cutouts, one of the edge cutouts of one of the partitions being of larger diameter than the other of the edge cutouts of the other of said partitions, the portions of each of said labyrinth seal in one of the parts engagable with the partitions in the labyrinth seals of the other of the parts when the parts are shut, with the partition edge cutouts forming sealing orifices of different diameters to provide effective sealing for electrical power cords of different sizes, and the clasp-like member being arranged to lock the parts together with pressure being exerted on the resilient gasket to effectively seal the housing around a plug and receptacle connection of two power cables;

wherein the housing is a cylinder with convex ends, thee mating edges of the first and second parts lie in a plan parallel to the axis of the cylinder, and the first and second labyrinth seals are located in opposite ends of the cylinder; and wherein the clasp-like member on the one part fits against an outside surface of the gasket on the other part to provide an overlapping seal when the first and second parts are in the shut position and the clasp is locked.

2. A weatherproof safety case for a plug and receptacle connection on respective ends of two electrical power cords, the case comprising:

a molded plastic housing divided into first and second parts having mating edges, an integrally molded hinge of thin plastic material joining the first and second parts along one side of said mating edges to permit pivoting the first and second parts between open and shut positions, and a clasp-like member extending alongside one of said mating edges of one of the parts opposite the hinge for releasably locking the first and second parts in the shut position;

a resilient gasket forming one of said mating edges of one of the first and second parts, the resilient gasket being formed with an enlarged pad adjacent to each end of the hinge for providing a seal between the hinge and the mating edges when the case is shut;

first and second labyrinth seals, each labyrinth seal being divided into two portions by the mating edges of the first and second parts of the housing, each portion coupled to one of the first and second parts of the housing, and being formed with at least two spaced apart flexible partitions having semicircular edge cutouts, one of the edge cutouts of one of the partitions being of larger diameter than the other of the edge cutouts of the other of said partitions, the portions of each of said labyrinth seals in one of the parts engagable with the partitions in the labyrinth seals of the other of the parts when the parts are shut, with the partition edge cutouts forming sealing orifices of different diameters to provide effective sealing for electrical power cords of different sizes, and the clasp-like member being arranged to lock the parts together with pressure being exerted on the resilient gasket to effectively seal the housing around a plug and receptacle connection of two power cables;

wherein the housing is a cylinder with convex ends, the mating edges of the first and second parts lie in a plan parallel to the axis of the cylinder, and the first and second labyrinth seals are located in opposite ends of the cylinder;

wherein each end of the first part is formed with a tongue extending from the mating edge of the first part, and the resilient gasket is formed with a groove in the mating edge of each end of the housing, the tongue of the first part fitting within the corresponding grooves of the gasket of the second part; and wherein the clasp-like member on the one part fits against an outside surface of the gasket on the other pan to provide an overlapping seal when the first and second parts are in the shut position and the clasp is locked.

3. A weatherproof safety case for a plug and receptacle connection on respective ends of two electrical power cords, the case comprising:

a molded plastic housing divided into first and second parts having mating edges, an integrally molded hinge of thin plastic material joining the first and second parts along one side of said mating edges to permit pivoting the first and second parts between open and shut positions, and a clasp-like member extending alongside one of said mating edges of one of the parts opposite the hinge for releasably locking the first and second parts in the shut position;

a resilient gasket forming one of-said mating edges of one of the first and second parts, the resilient gasket being formed with an enlarged pad adjacent to each end of the hinge for providing a seal between the hinge and the mating edges when the case is shut;

first and second labyrinth seals, each labyrinth seal being divided into two portions by the mating edges of the first and second parts of the housing, each portion coupled to one of the first and second parts of the housing, and being formed with at least two spaced apart flexible partitions having semicircular edge cutouts, one of the edge cutouts of one of the partition being of larger diameter than the other of the edge cutout of the other of said partitions, the portions of each of said labyrinth seals in one of the parts engagable with the partitions in the labyrinth seals of the other of the parts when the parts are shut, with the partition edge cutouts forming sealing orifices of different diameters to provide effective sealing for electrical power cords of different sizes, and the clasp-like member being arranged to lock the parts together with pressure being exerted on the resilient gasket to effectively seal the housing around a plug and receptacle connection of two power cables;

wherein the housing is a cylinder with convex ends, the mating edges of the first and second parts lie in a plan parallel to the axis of the cylinder, and the first and second labyrinth seals are located in opposite ends of the cylinder; and wherein the clasp-like member comprises a cylindrical section molded integrally with the first part of the housing, with a flexible hinge section joining an edge of the member to the mating edge of the first part, a longitudinal lip extending from an inner surface of the member adjacent to an edge of the member opposite the binge section, and the second part of the housing has a longitudinal groove in its outer surface, the groove being arranged to receive the longitudinal lip in locking engagement when the two parts of the housing are in the shut position with said preload applied to the gasket.

* * * * *

UNITED STATES PATENT AND TRADEMARK OFFICE

CERTIFICATE OF CORRECTION

PATENT NO. : 5,834,690
DATED : November 10, 1998
INVENTOR(S) : Christ A.C.A. Bastiaansen It is certified that error appears in the above-identified patent and that said Letters Patent is hereby corrected as shown below:

Delete the specification and replace it with the new specification as shown on the attached pages.

Signed and Sealed this

Eighth Day of October, 2002

*Attest:*

*Attesting Officer*

JAMES E. ROGAN
*Director of the United States Patent and Trademark Office*

SPATTER, DUST AND RAIN-PROOF PLASTIC SAFETY CASE INTENDED FOR EXTENSION CORD PLUGGING

FIELD OF THE INVENTION

The present invention relates generally to weatherproof coverings and more particularly to a safety case to protect the connection between the male plug and female receptacle on the respective ends of two electrical power cords. The present invention is especially applicable to outdoor connection of electric hand tools and portable apparatus, such as vacuum cleaners, to the main outlet.

BACKGROUND OF THE INVENTION

Problems associated with unprotected plug and receptacle connections are well-known and include, for example: accidental disconnection due to cord tension; the danger of exposing small children to potential electric shock; short-circuits caused by spattering, rain, gutter-water, and puddles; and corrosion of the plug prongs over the life of the extension cord.

The present invention is therefore directed to the problem of developing a safety case that prevents the aforementioned problems.

SUMMARY OF THE INVENTION

The present invention solves this problem by providing that the case includes a substantially cylindrical tube with hemispherical end portions. The container is separated into upper and lower parts by a plane coinciding with the longitudinal axis of the container. Both the upper and lower parts are connected to each other by an integrally molded hinge-joint of thin plastic material created during the injection molding process.

After being closed by a click-fastener system, the case parts are locked together. An adult user can unlock and open the case by placing a thumb into a recess on the case circumference and exerting force to open the case. For safety reasons, the construction details, dimensions, and required force are selected to prevent small children from performing this operation. Waterproof plug connections are known and available commercially. Because these waterproof plug connections are guaranteed for underwater use, they are designed serve a different purpose and subject to government regulation. Accordingly, waterproof plug connections are not competitive with the present invention, which is directed to domestic applications where weatherproofing is essential to protect users of portable appliances against potentially fatal electric shock. Short-circuiting can also be caused by corrosion of the prongs due to penetration of moisture and wetness that occurs when the extension cords are used outdoors. The present invention protects against this problem as well.

Plug cases lacking the features of the present invention do not meet the basic safety concerns associated the use of electric tools and equipment in adverse weather conditions and/or a dusty environment. For the above-mentioned reasons, one innovation of the present invention is the seal between the contacting surfaces of upper and lower case parts, especially at the area where one sealing mechanism interfaces with another. An example of one such sealing mechanism occurs on either side of the hinge joint where small adjoining square rubber gaskets form one part of the weatherproof seal. The gaskets in the circumference of the separated hemispheres of the two case parts are interlocking male and female gaskets. The rubber sealing opposite the hinge is molded at its base to the recessed edges because the click-fastening system is situated in the same plane. Accordingly, the sealing along those edges are interlocking male and female gaskets as well. After the clasp is locked, the case becomes fully closed and fully sealed including the sealing of the end closures. Accordingly, the perimeter of both case halves are adequately sealed.

The seal of the cable ingress is attained by means of a internal rubber labyrinth seal arranged to allow different cable thicknesses. A rubber labyrinth seal such as is effective for cables of various thickness. For each corresponding cable thickness there are at least two pairs of semi-circular annular rubber partition skirts. The material flexibility of these skirts is selected to obtain optimal cable sealing. The seal of the cable ingress contributes essentially to the overall sealing behavior of the case according to the present invention.

The present invention is particularly applicable to circumstances where electricity and water are used simultaneously. For example, when one operator is handling a garden hose outdoors while another operator is simultaneously operating a vacuum cleaner inside of a car. Other applications of note include outdoor Christmas tree lighting, supplying electricity to caravans, and moreover, for all general applications requiring extension cords. One embodiment of the invention shall be explained by way of example in which less relevant details are omitted for the sake of clarity.

DETAILED DESCRIPTION

Figure 1:
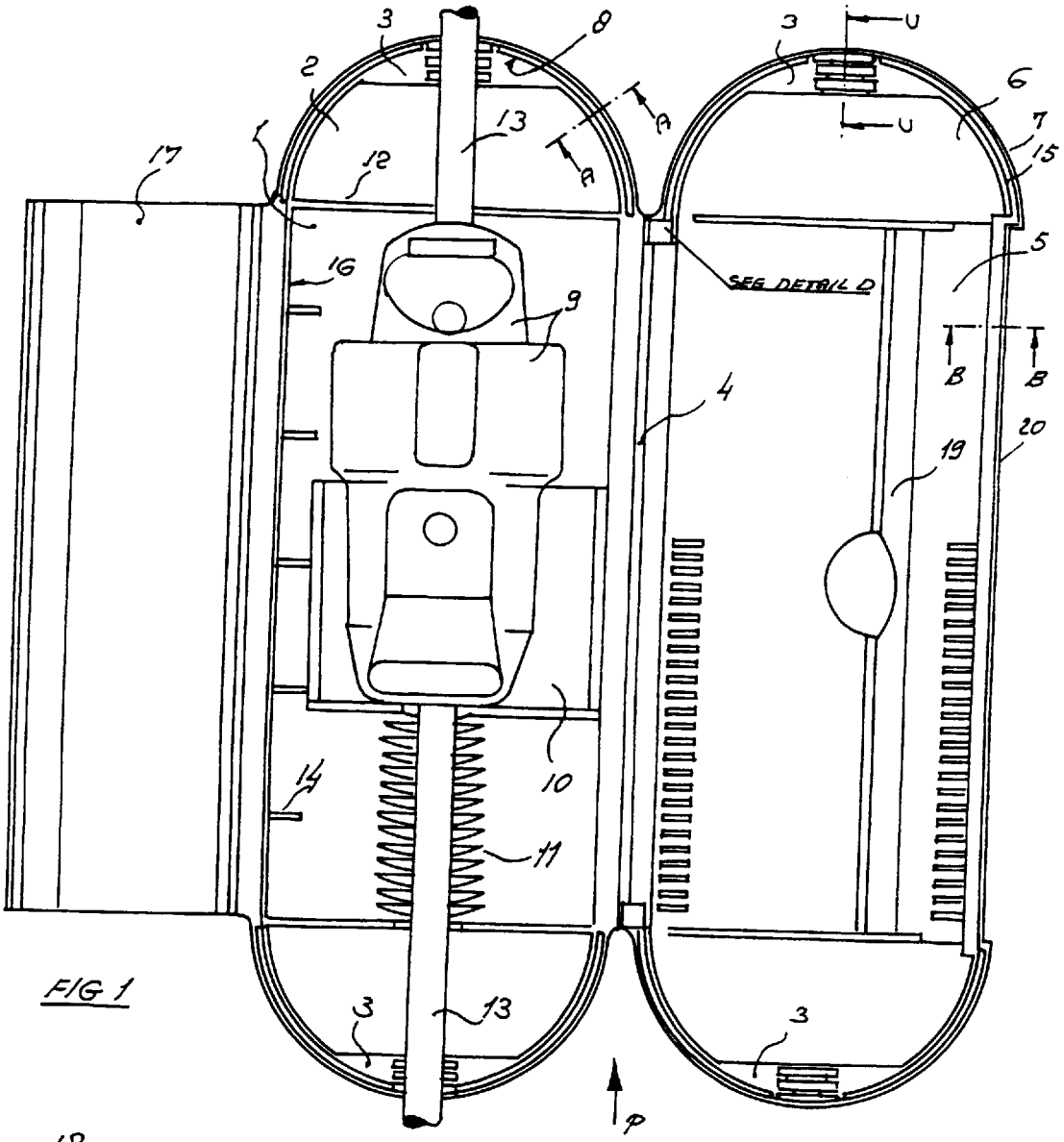
FIG. 1 is a front-view of the fully-opened case of the present invention with the male plug and female receptacle positioned in the case and longitudinally fixed by means of an adjustable half open seat, which on its sliding side is provided with teeth, corresponding the those molded inside the case bottom, by which the cleats in the opposite half maintain this position as long as the case remains secured.
Figure 2:
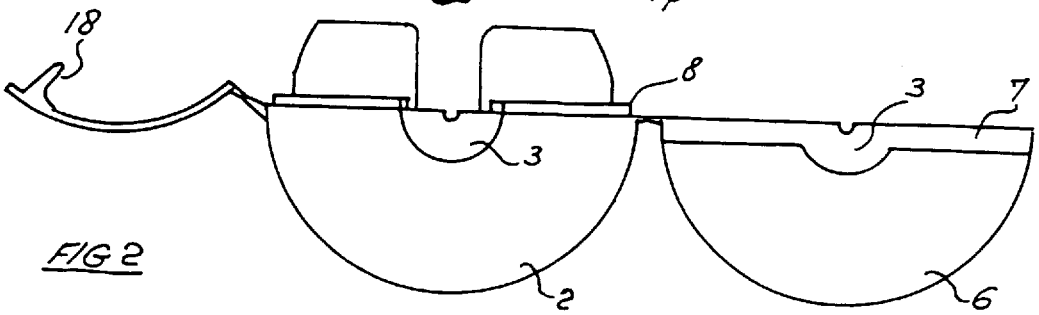
FIG. 2 is an end-view of the opened case from the direction P as indicated in FIG. 1. In this drawing, dotted lines, which would normally delineate the internal construction details, are intentionally omitted for clarity. Moreover, again for clarity, the plug which should be partly visible is also intentionally omitted. The adjustable seat outlines are not visible and are hidden by one of the fixed part-partition plates molded to the front closures of the bottom part and coinciding with its tangent line. Both the injection molded hinge, which connects the upper and lower parts, and the unlocked fastener-hinge are clearly visible in this FIG.
Figure 3:
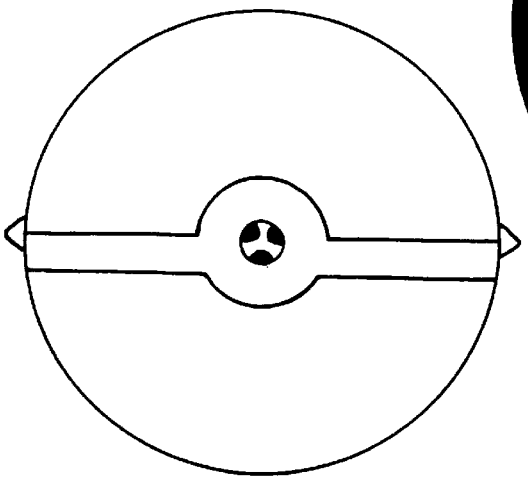
FIG. 3 is an end-view of the case of the present invention when closed.

In order to avoid any confusion, first, construction of the case itself shall be described in detail with incidental reference to the seal. Second, the seal shall be described in greater detail.

FIGS. 1–4 illustrate the lower case half 1 in which the plug combination 9 is fitted. The lower case half 1 is provided with lower semi-hemispheres 2, each including semi-circular labyrinth seals 3 in the center. A hinge 4 consists of a thin material layer and is created during the injection molding process. The hinge 4 connects the lower case half 1 to the upper case half 5. The upper case half 5 is provided with upper semi-hemispheres 6 which include labyrinth seals 3. A grooved resilient rubber gasket 7 is seamlessly joined along the circumferential or mating edges of the semi-hemispheres 6. The grooved rubber gasket 7 interfaces with the ledge 8 which is molded to the lower semi-hemispheres 2.

Figure 5:
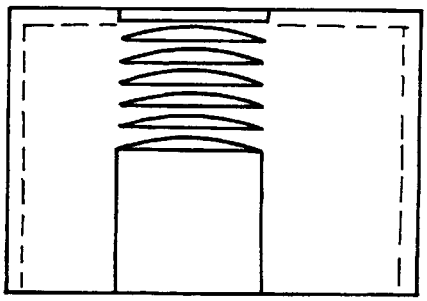
FIG. 5 is a side-view of the bottom part of the adjustable half-open seat, with which the combined plug connection can be fixed independent of its shape and dimensions as long as it is situated within the limitations given by the internal housing dimensions.
Figure 6:
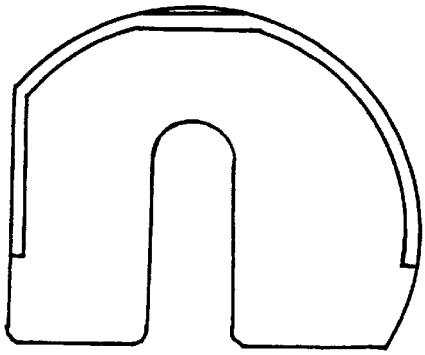
FIG. 6 is a front-view of the adjustable seat, provided with a slotted hole for cable transit, corresponding with the slotted hole in the fixed part partition plate coinciding with the front tangent line.

The plug combination 9 is positioned in the adjustable seat 10 by moving the adjustable seat 10 in the direction of the end partition plate 12. FIGS. 5 and 6 further illustrate the adjustable seat 10 in greater detail.

Referring back to FIG. 1 the positive toothing 11 or stops, molded to the bottom of case half 1 and the upper half of the case 5, prevents the adjustable seat 10 or cradle from moving while the cable 13 is seated on the half portion of the labyrinth seal 3. The cams 14 prevent oblique positioning of the adjustable seat 10. The ledge 8 is integrally molded to the front edges and corresponds with the groove 15 which is injection molded into the grooved rubber gasket 7 of the semi-hemispherical fronts 6. The ledge 16 of the lower case part 1 corresponds with the sealing opposite the hinge on the edge of the upper case part 5, after closing and securing both halves by means of clasp 17, thus forming a male and female seal.

In operation, the case is locked when the plug combination 9 is placed in the case, the case halves 1 and 5 are closed, and the clasp 17 is firmly pressed in the longitudinal direction into the corresponding free space 19 of the upper case half 5.

The sealing properties of the case according to the present invention are essential for its functioning under all of the designed conditions, especially in bad weather and less than ideal environmental conditions. Without the seal the case will not adequately weatherproof the plug connection.

In order to meet the aforesaid design requirements, a fabrication method is selected that fuses rubber gaskets with plastic housing material in a second preheated mold. This fabrication method produces a higher quality fuse in comparison to cold molding or hot vulcanizing procedures outside the mold.

Figure 9:
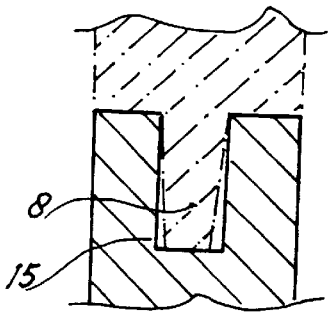
FIG. 9 is a cross-sectional view of the gasket construction in the circumference of the hemispherical portions, including a hard plastic male portion and medium hard rubber female portion. A conically-shaped male part is shown in dotted lines.

FIG. 9 illustrates the beveled side of the ledge 8 interlocking with the rubber groove 15 of the grooved rubber gasket 7, as described above. The sealing gasket 7 is heat fused to the edges of the upper semi-hemispheres 6.

Figure 10:
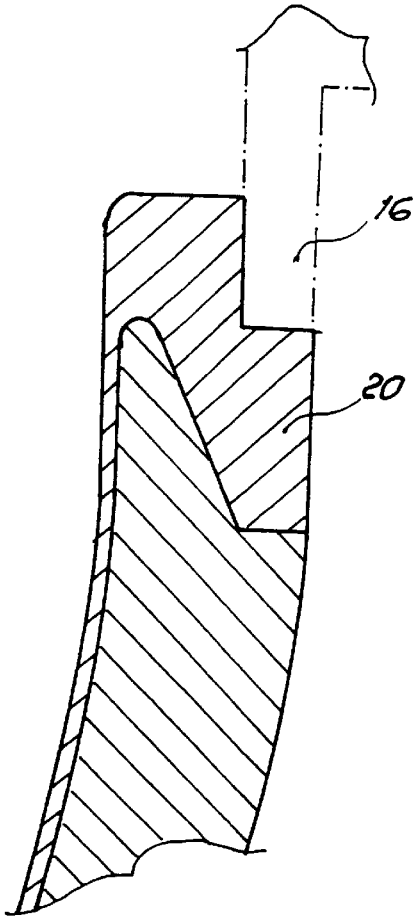
FIG. 10 is a cross-sectional view of the seal opposite the hinge in with the click-fastener system in the opened position.

FIG. 10 illustrates the longitudinal gasket 20 joined to grooved rubber gasket 7, which is recessed and constructed in such a way that, after securing by closing and click-fastening, the circular cross sectional form maintains its shape and no parts are sticking out.

However, in closed condition an uninterrupted sealing surface exist due to the shape of the longitudinal gasket 20, which joins the grooved rubber gasket 7. This grooved rubber 7 is provided with the same recessed construction as the upper case half 5. Along the small strip surface on the lower case part 1 (adjacent to hinge 24), the clasp 17 itself shall touch the outside surface of the longitudinal gasket 20, in this way effectuating a triangle sealing function along the closing side between the edges of the semi-hemispherical end closures 2 and 6, a function in addition to its bolting and securing functions.

Figure 7:
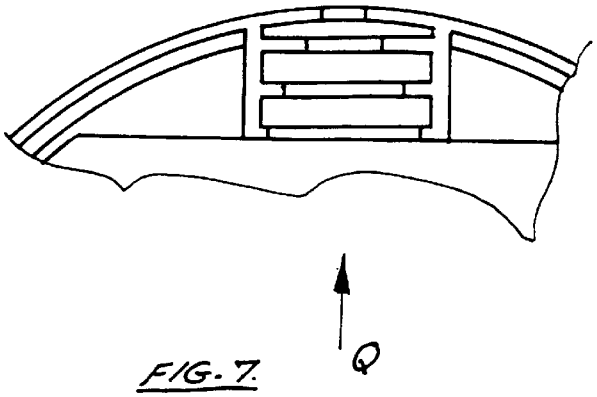
FIG. 7 is a front-view of the labyrinth seal for cable transit.
Figure 8:
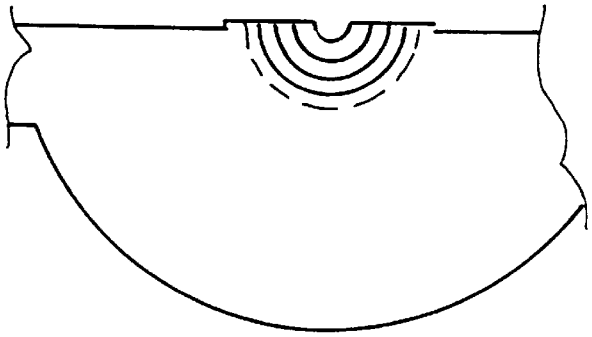
FIG. 8 is a end-view of the labyrinth seal for cable transit.

FIGS. 7 and 8 illustrate the corresponding labyrinth seals 3 in greater detail. The labyrinth seals 3 seal the cables 13 to achieve sufficient tightness, each pair together acting like an orifice.

Figure 11:
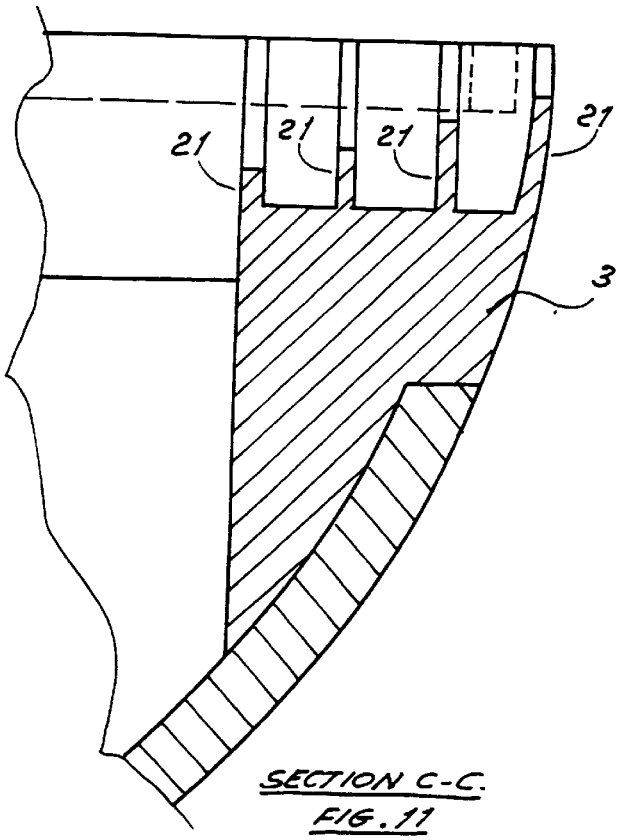
FIG. 11 is a cross-sectional view of the labyrinth seal as fitted into the cable nozzle and its converging bored partitions.

FIG. 11 illustrates a detailed cross-section of the labyrinth seal 3, which includes a series of semi-circular annular partitions 21. The internal diameters of the partitions vary to accommodate sealing for a variety of diameters of cables 13.

Figure 12:
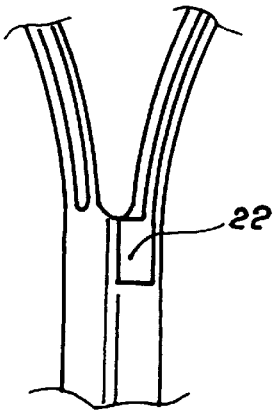
FIG. 12 is a detail view of one of the small rubber squares on either side of the hinge.

FIG. 12 illustrates the small rubber square 22 which is located on both ends of the self-sealing hinge 4 (not shown in FIG. 12). The small rubber square 22 is molded to the grooved rubber gasket 7 on the semi-hemispherical fronts 6, and provides the sealing gap between both systems. Failure to include the small rubber gasket 22 will result in leakage. This and the above mentioned and described sealing details are essential for the overall tightness of the case of the present invention.

The present invention is intended for safe outdoors use of extension cords with male and female plug connections.

Figure 4:
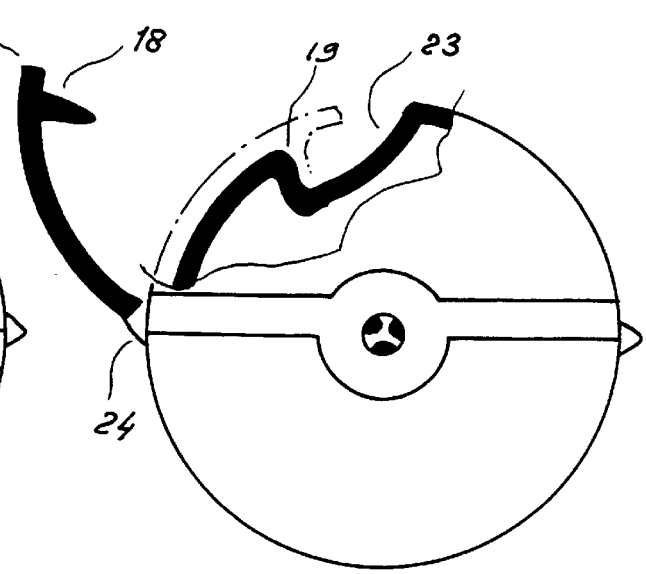
FIG. 4 is an end-view of the case of the present invention with a cut-away section of the click-fastener shown in greater detail.

FIG. 4 further illustrates the free thumb space 23 in the upper case 5. The free thumb space 23 facilitates unlocking of the click-fastener 17, also referred to as a clasp, but the required force is such make it impossible of infants and smaller children to unlock.

What is claimed is:

1. A weatherproof safety case for a plug and receptacle connection on respective ends of two electrical power cords, the case comprising;

a molded plastic housing divided into first and second parts having mating edges, an integrally molded hinge of thin plastic material joining the first and second parts along one side of said mating edges to permit pivoting the first and second parts between open and shut positions, and a clasp-like member extending alongside one of said mating edges of one of the parts opposite the hinge for releasably locking the first and second parts in the shut position;

a resilient gasket forming one of said mating edges of one of the first and second parts, the resilient gasket being formed with an enlarged pad adjacent to each end of the hinge for providing a seal between the hinge and the mating edges when the case is shut;

first and second labyrinth seals, each labyrinth seal being divided into two portions by the mating edges of the first and second parts of the housing, each portion coupled to one of the first and second parts of the housing, and being formed with at least two spaced apart flexible partitions having semicircular edge cutouts, one of the edge cutouts of one of the partitions being of larger diameter than the other of the edge cutouts of the other of said partitions, the portions of each of said labyrinth seals in one of the part engagable with the partitions in the labyrinth seals of the other of the parts when the parts are shut, with the partition edge cutouts forming sealing orifices of different diameters to provide effective sealing for electrical power cords of different sizes, and the clasp-like member being arranged to lock the parts together with pressure being exerted on the resilient gasket to effectively seal the housing around a plug and receptacle connection of two power cables;

wherein the housing is a cylinder with convex ends, the mating edges of the first and second parts lie in a plan parallel to the axis of the cylinder, and the first and second labyrinth seals are located in opposite ends of the cylinder; and wherein the clasp-like member on the one part fits against an outside surface of the gasket on the other part to provide an overlapping seal when the first and second parts are in the shut position and the clasp is locked.

2. A weatherproof safety case for a plug and receptacle connection on respective ends of two electrical power cords, the case comprising:

a molded plastic housing divided into first and second parts having mating edges, an integrally molded hinge of thin plastic material joining the first and second parts along one side of said mating edges to permit pivoting the first and second parts between open and shut positions, and a clasp-like member extending alongside one said mating edges of one of the parts opposite the hinge for releasably locking the first and second parts in the shut position;

a resilient gasket forming one of said mating edges of one of the first and second parts, the resilient gasket being formed with an enlarged pad adjacent to each end of the hinge for providing a seal between the hinge and the mating edges when the case is shut;

first and second labyrinth seals, each labyrinth seal being divided into two portions by the mating edges of the first and second parts of the housing, each portion coupled to one of the first and second parts of the housing, and being formed with at least two spaced apart flexible partitions having semicircular edge cutouts, one of the edge cutouts of one of the partitions being of larger diameter than the other of the edge cutouts of the other of said partitions, the portions of each of said labyrinth seals in one of the parts engagable with the partitions in the labyrinth seals of the other of the parts when the parts are shut, with the partition edge cutouts forming sealing orifices of different diameters to provide effective sealing for electrical power cords of different sizes, and the clasp-like member being arranged to lock the parts together with pressure being exerted on the resilient gasket to effectively seal the housing around a plug and receptacle connection of two power cables;

wherein the housing is a cylinder with convex ends, the mating edges of the first and second parts lie in a plan parallel to the axis of the cylinder, and the first and second labyrinth seals are located in opposite ends of the cylinder;

wherein each end of the first part is formed with a tongue extending from the mating edge of the first part, and the resilient gasket is formed with a groove in the mating edge of each end of the housing, the tongue of the first part fitting within the corresponding grooves of the gasket of the second part; and wherein the clasp-like member on the one part fits against an outside surface of the gasket on the other part to provide an overlapping seal when the first and second parts are in the shut position and the clasp is locked.

3. A weatherproof safety case for a plug and receptacle connection on respective ends of two electrical power cords, the case comprising:

a molded plastic housing divided into first and second parts having mating edges, an integrally molded hinge of thin plastic material joining the first and second parts along one side of said mating edges to permit pivoting the first and second parts between open and shut positions, and a clasp-like member extending alongside one of said mating edges of one of the parts opposite the hinge for releasably locking the first and second parts in the shut position;

a resilient gasket forming one of said mating edges of one of the first and second parts, the resilient gasket being formed with an enlarged pad adjacent to each end of the hinge for providing a seal between the hinge and the mating edges when the case is shut;

first and second labyrinth seals, each labyrinth seal being divided into two portions by the mating edges of the first and second parts of the housing, each portion coupled to one of the first and second parts of the housing, and being formed with at least two spaced apart flexible partitions having semicircular edge cutouts, one of the edge cutouts of one the partitions being of larger diameter than the other of the edge cutouts of the other of said partitions, the portions of each of said labyrinth seals in one of the parts engagable with the partitions in the labyrinth seals of the other of the parts when the parts are shut, with the partition edge cutouts forming sealing orifices of different diameters to provide effective sealing for electrical power cords of different sizes, and the clasp-like member being arranged to lock the parts together with pressure being exerted on the resilient gasket to effectively seal the housing around a plug and receptacle connection of two power cables;

wherein the housing is a cylinder with convex ends, the mating edges of the first and second parts lie in a plan parallel to the axis of the cylinder, and the first and second labyrinth seals are located in opposite ends of the cylinder; and wherein the clasp-like member comprises a cylindrical section molded integrally with the first part of the housing, with a flexible hinge section joining an edge of the member to the mating edge of the first part, a longitudinal lip extending from an inner surface of the member adjacent to an edge of the member opposite the binge section, and the second part of the housing has a longitudinal groove in its outer surface, the groove being arranged to receive the longitudinal lip in locking engagement when the two parts of the housing are in the shut position with said preload applied to the gasket.

* * * * *